US007493714B2

(12) United States Patent
Yang

(10) Patent No.: US 7,493,714 B2
(45) Date of Patent: Feb. 24, 2009

(54) DECORATIVE DEVICE ENABLING ORNAMENTS TO SWAY BACK AND FORTH INSIDE A CRYSTAL BALL AMIDST FLUTTERING, SHINY DISC SNOWFLAKES

(75) Inventor: Shin-Ya Yang, Hsin Tien (TW)

(73) Assignee: Ya Yung Enterprise Co., Ltd., Taipei Hsien (TW)

( * ) Notice: Subject to any disclaimer, the term of this patent is extended or adjusted under 35 U.S.C. 154(b) by 116 days.

(21) Appl. No.: 11/709,605

(22) Filed: Feb. 22, 2007

(65) Prior Publication Data

US 2008/0202001 A1 Aug. 28, 2008

(51) Int. Cl.
*G09F 19/00* (2006.01)

(52) U.S. Cl. ..... 40/406; 40/427; 40/430

(58) Field of Classification Search ..... 40/406–410, 40/427, 429, 430
See application file for complete search history.

(56) References Cited

U.S. PATENT DOCUMENTS

| | | | | |
|---|---|---|---|---|
| 5,396,723 | A * | 3/1995 | Liu | 40/406 |
| 6,508,022 | B2 * | 1/2003 | Huang | 40/426 |
| 6,588,130 | B1 * | 7/2003 | Yang | 40/410 |

* cited by examiner

*Primary Examiner*—Cassandra Davis
(74) *Attorney, Agent, or Firm*—Pro-Techtor Int'l Services

(57) ABSTRACT

A decorative device enabling ornaments to sway back and forth inside a crystal ball amidst fluttering, shiny disc snowflakes, which uses a device structured from a motor mechanism, a gear mechanism, a rocking mechanism and a crystal ball so that when a motor drives and rotates transmission gears of the gear mechanism, apart from using mutually repelling of two double-sided magnets to drive and rotate a magnet impeller wheel, and thereby cause whirling of water and fluttering of shiny disc snowflakes within the crystal ball, moreover, rotating of a main transmission shaft causes rotating of rocking horse swaying back and forth.

1 Claim, 5 Drawing Sheets

DECORATIVE DEVICE ENABLING ORNAMENTS TO SWAY BACK AND FORTH INSIDE A CRYSTAL BALL AMIDST FLUTTERING, SHINY DISC SNOWFLAKES

BACKGROUND OF THE INVENTION (a) Field of the Invention

The present invention relates to a design of a snowflakes crystal ball, and more particularly to a multifunctional design of a snowflakes crystal ball enabling ornaments to sway back and forth inside a crystal ball amidst fluttering, striking shiny disc snowflakes.

(b) Description of the Prior Art

Liquid flowing inside a conventional snowflake crystal ball causes the fluttering of shiny discs, thereby forming the striking appearance of fluttering snowflakes. However, toy figurines or ornaments disposed interior of the crystal ball are not provided with functionality to sway back and forth, and thus the crystal ball is merely provided with the function to produce the impression of striking snowflakes. Hence, there is a need for improvement on prior art.

SUMMARY OF THE INVENTION

A primary object of the present invention is to provide a striking snowflakes crystal ball of prior art with distinctive toy figurines or ornaments disposed interior thereof, in addition, the main transmission shaft of the gear mechanism drives and rotates the horse ornaments sway back and forth.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
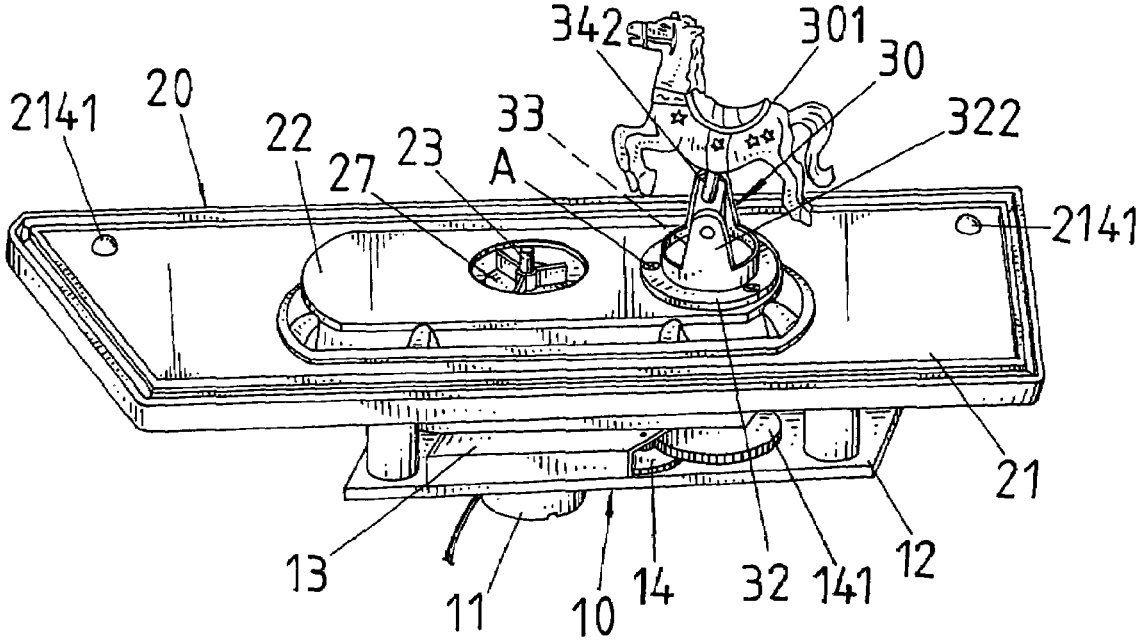
FIG. 1 shows an elevational view depicting assembly of a motor mechanism, gear mechanism and rocking mechanism according to the present invention.
Figure 2:
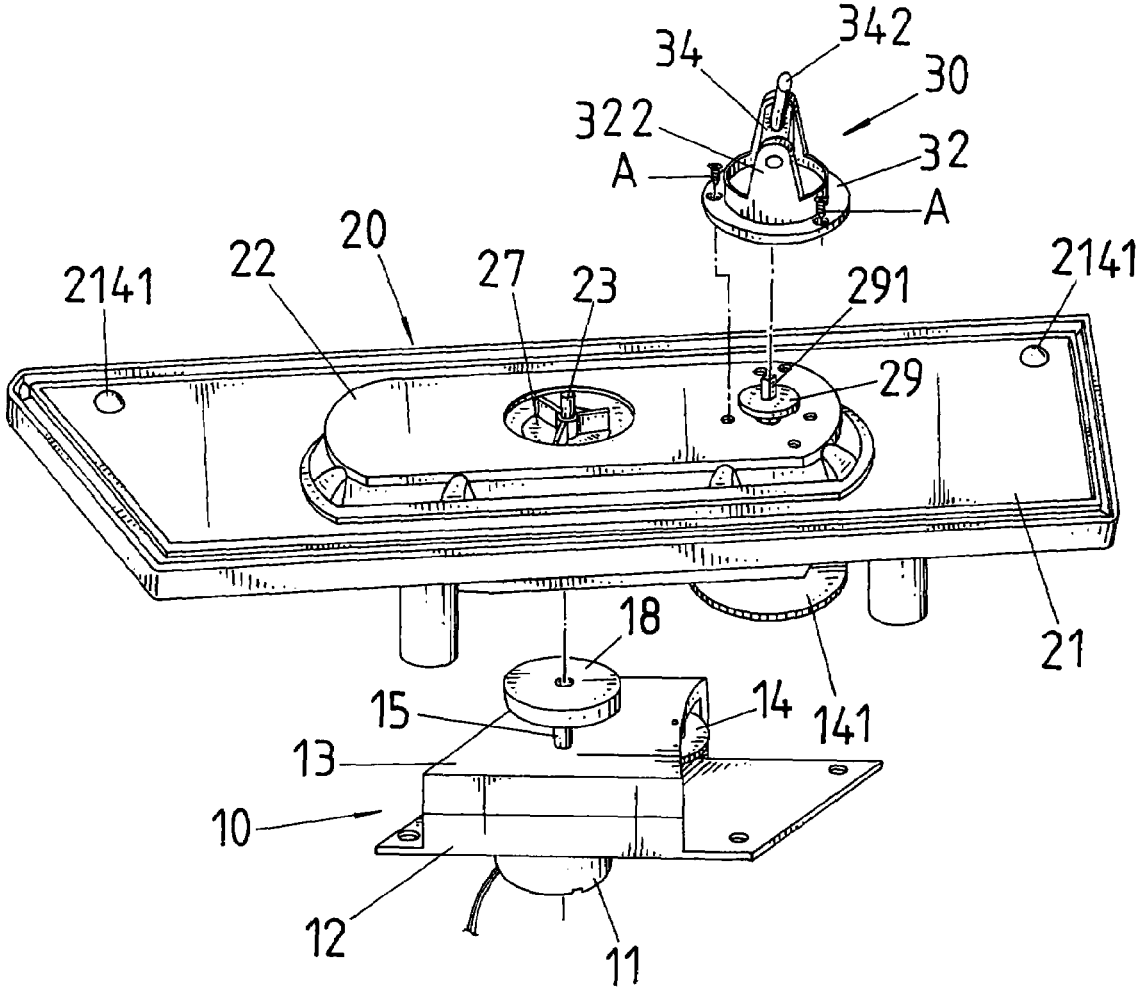
FIG. 2 shows an exploded elevational view of the motor mechanism, the gear mechanism and the rocking mechanism according to the present invention.

Referring to FIGS. 1 and 2, which show the present invention primarily structured to comprise a motor mechanism 10, a gear mechanism 20, a rocking mechanism 30 and a crystal ball 40

Figure 5:
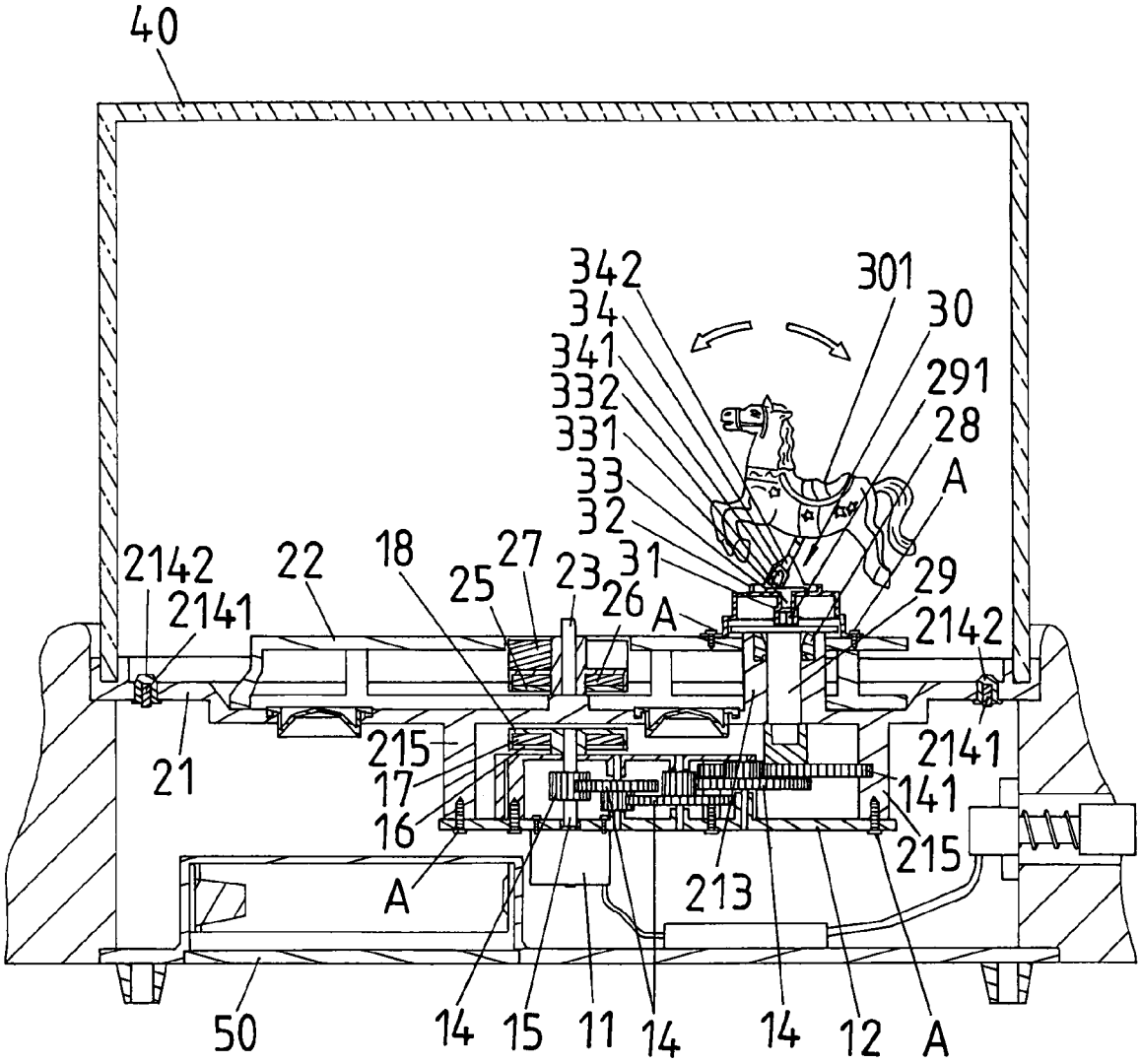
FIG. 5 shows a cross-sectional view of the present invention.

Referring to FIG. 5, which shows a base 50 disposed beneath the crystal ball 40 used to retain the aforementioned mechanisms, and wherein the crystal ball 40 is filled with water and shiny disc snowflakes (not shown in the drawings). The motor mechanism 10 is installed beneath the gear mechanism 20, and the rocking mechanism 30 is installed above the gear mechanism 20.

Figure 3:
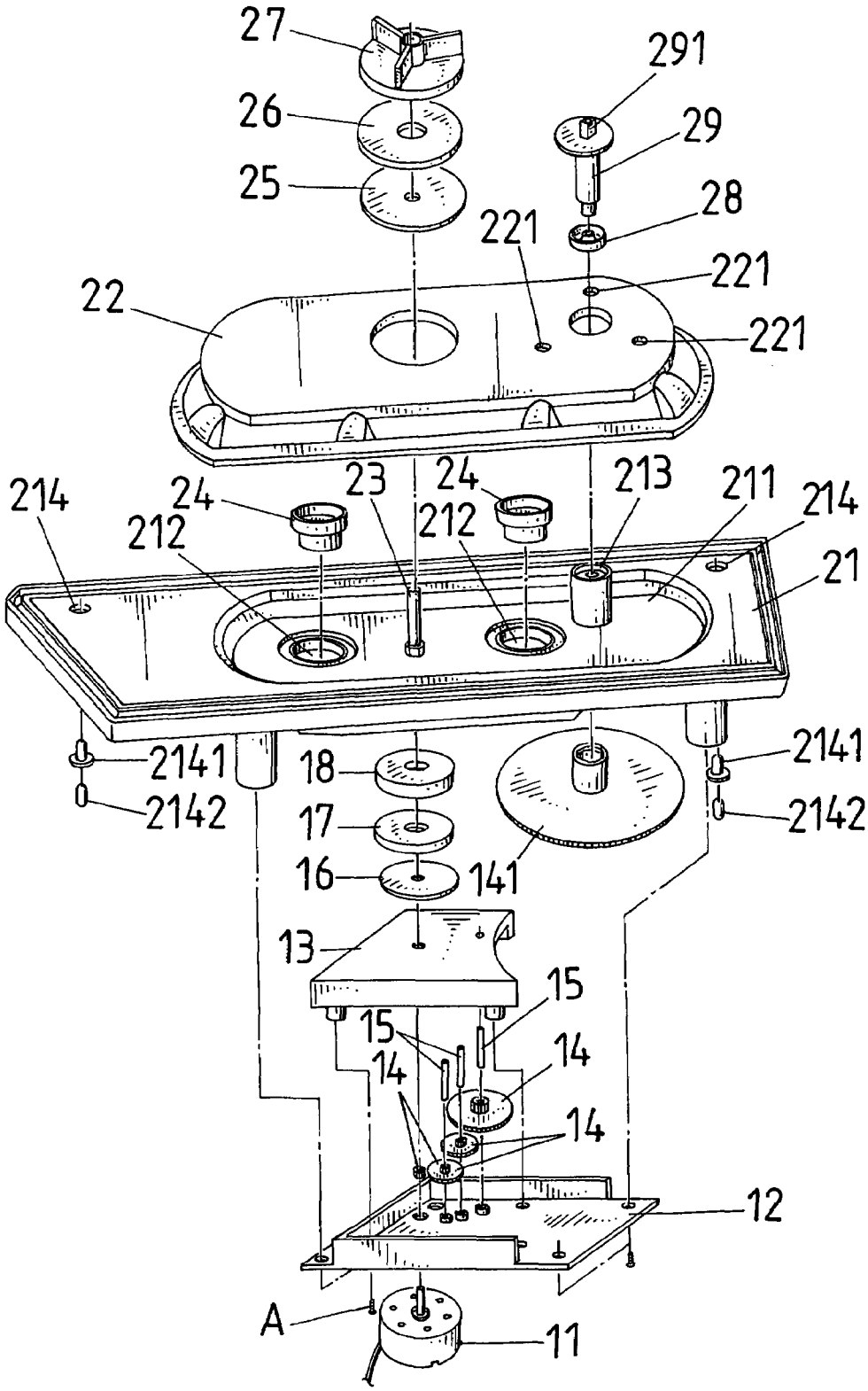
FIG. 3 shows an exploded elevational view of the motor mechanism and the gear mechanism according to the present invention.

Referring to FIG. 3, wherein the motor mechanism 10 is structured to comprise a motor 11, a gear set supporting frame 12, a gear set gland 13, four transmission gears 14, gear shafts 15, a magnet gland 16, a double-sided magnet 17 and a transmission magnet gland 18. The four transmission gears 14 and a transmission gear 141 are installed between the gear set supporting frame 12 and the gear set gland 13 (see FIG. 5), and the motor 11 is installed beneath the gear set supporting frame 12. The gear shafts 15 are linked to the transmission gears 14, and, after penetrating the gear set gland 13, respectively penetrate the magnet gland 16, the double-sided magnet 17 and the transmission magnet gland 18. The gear mechanism 20 is structured to comprise a carrier frame 21, a gland 22, a magnet impeller shaft 23, two air rubber plugs 24, a magnet gland 25, a double-sided magnet 26, a magnet impeller 27, a watertight gasket 28 and a main transmission shaft 29. The gland 22 is disposed on and covers a recess 211 of the carrier frame 21, and two air rubber plug holes 212 defined in the recess 211 enable the two air rubber plugs 24 to be respectively embedded therein. The magnet impeller shaft 23 center of the recess 211 respectively penetrates the magnet gland 25, the double-sided magnet 26 and the magnet impeller 27. A watertight ring support 213 at one end of the recess 211 enables the watertight gasket 28 and the main transmission shaft 29 to be disposed interior thereof, and watertight plastic plug holes 214 each having a watertight plug 2141 and an expanding bolt 2142 fixedly bolted therein are respectively defined lateral to the recess 211. A lower portion of the carrier frame 21 is provided with fixing posts 215, and screws A penetrate the gear set supporting frame 12 and are fixedly bolted within post holes of the fixing posts 215.

Figure 4:
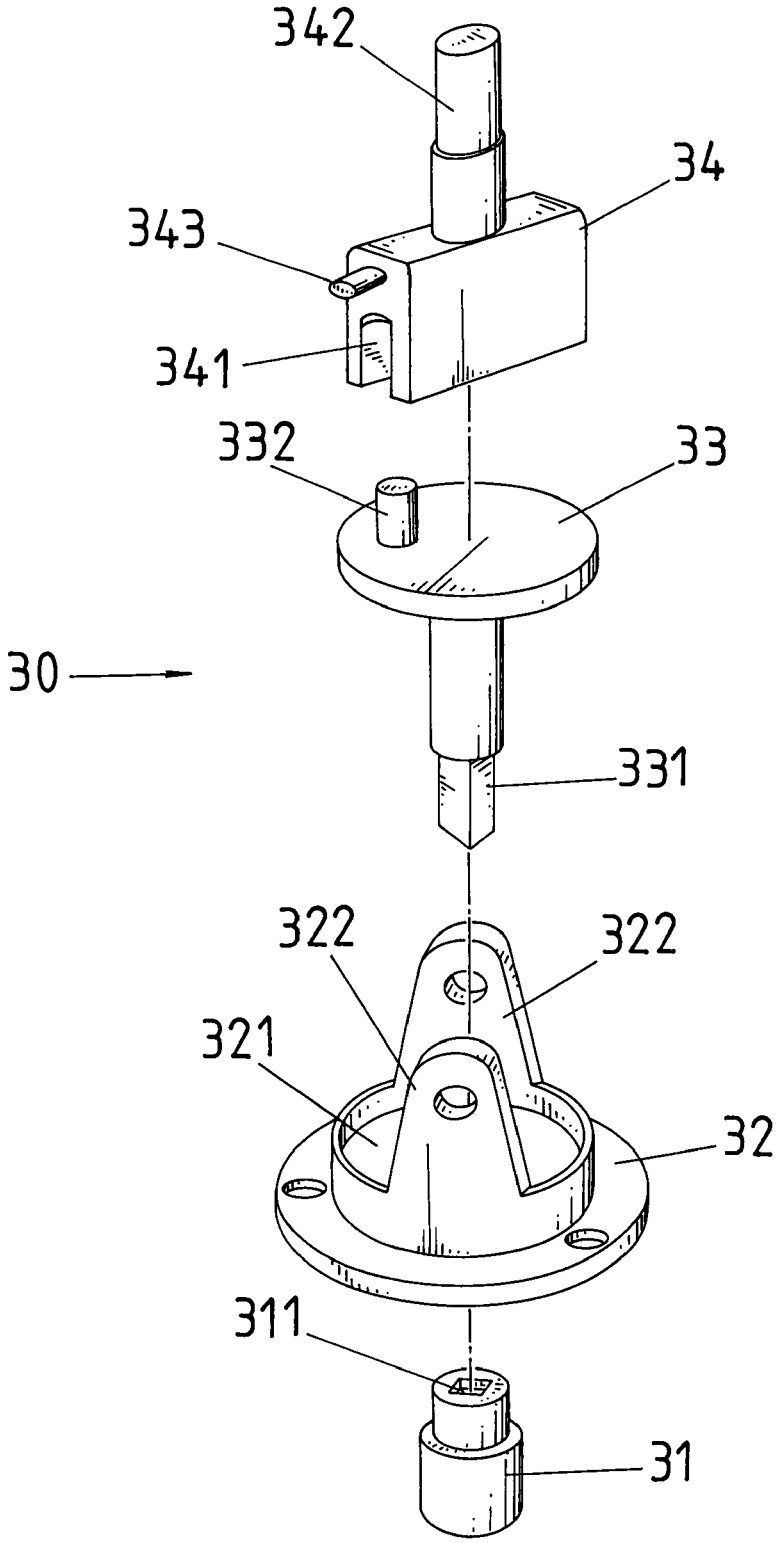
FIG. 4 shows an exploded elevational view of the rocking mechanism according to the present invention.

Referring to FIG. 4, which shows the rocking mechanism 30 structured to comprise a rocking horse 301, a main power transmission member 31, a rocking support 32, an eccentric wheel 33, and a rocking slide 34; wherein the main power transmission member 31 is latched on an embedding piece 291 of the main transmission shaft 29 (see FIG. 3), and the main power transmission member 31 is locked on the gland 22 of the gear mechanism 20 by a screw A, with a latching hole 311 at a top end of the main power transmission member 31 being located below a through-hole of the rocking support 32. In addition, a circular sink 321 is located above the rocking support 32, and two sides of the circular sink 321 are provided with protruded arc-shape lumps 322. The eccentric wheel 33 is emplaced horizontally in the circular sink 321 of the rocking support 32, a latching shaft 331 below the eccentric wheel 33 is transfixed into the through-hole of the rocking support 32 and is latched into the latching hole 311 of the main power transmission member 31 for positioning, a groove 341 at a bottom end of the rocking slide 34 provides for an emplacement of a poking stick 332 of the eccentric wheel 33, a connection shaft 342 is located above the rocking slide 34 to connect with a rocking horse 301, and a sliding rod 343 is located at a side edge of the rocking slide 34. When the motor 11 drives and rotates the transmission gears 14, 141, apart from mutual repelling of the upper and lower double-sided magnets 26, 17 driving and rotating the magnet impeller wheel 27, and thereby causing the main power transmission member 31 to drive the eccentric wheel 33 to rotate, the poking stick 332 of the eccentric wheel 33 to drive the rocking slide 34 to rotate, and the sliding rod 343 of the rocking slide 34 to move on the arc-shape lumps 332 of the rocking support 32, so as to drive the rocking horse 301 to sway back and forth. The crystal ball 40 can be square shaped or designed with different shapes, including circular shaped, diamond shaped, and so on.

In conclusion, the crystal ball 40 of the present invention has functionality to give the impression of fluttering, striking shiny disc snowflakes of prior art, as well as providing functionality to enable swaying back and forth of the rocking horse 301. Furthermore, the crystal ball 40 of the present invention further enables configuration with a music bell.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A decorative device enabling ornaments to sway back and forth inside a crystal ball amidst fluttering, shiny disc snowflakes, comprising a motor mechanism, including a motor; a gear set supporting frame positioned above the motor; a gear set gland that covers the gear set supporting frame; a plurality of transmission gears positioned between the gear set supporting frame and the gear set gland; and which mutually mesh; a plurality of gear shafts respectively extending into centers of the transmission gears; a lower magnet gland positioned above the gear set gland that enables the gear shafts to penetrate therethrough; a lower double-sided magnet positioned above the lower magnet gland that enables the gear shafts to penetrate therethrough; a transmission magnet gland positioned above the double-sided magnet that enables the gear shafts to penetrate therethrough; a gear mechanism, including a carrier frame, an upper surface of which is provided with a recess, two air rubber plug holes and a watertight ring support; a carrier frame gland that covers the recess of the carrier frame, a plurality of bolt holes are defined in the carrier frame gland; a magnet impeller shaft positioned center of the recess of the carrier frame; two air rubber plugs that are respectively fixedly plugged into the air rubber plug holes; an upper magnet gland positioned in the carrier frame gland that enables the magnet impeller shaft to penetrate therethrough; an upper double-sided magnet positioned above the upper magnet gland that enables the magnet impeller shaft to penetrate therethrough; a magnet impeller positioned above the upper double-sided magnet that enables the magnet impeller shaft to penetrate therethrough a watertight gasket positioned within the watertight ring support of the carrier frame; a main transmission shaft that penetrates the watertight gasket and extends into the watertight ring support of the carrier frame, an upper portion of the main transmission shaft is provided with an embedding piece; a rocking mechanism, including a rocking horse; a main power transmission member which is latched on an embedding piece of the main transmission shaft, and is provided with a latching hole; a rocking support, a top of which is provided with a circular sink, two sides of which are provided respectively with arc-shape lumps, and a central through-hole of which is located close to the latching hole of the main power transmission member; an eccentric wheel, below which is a latching shaft which is transfixed into the through-hole of the rocking support to be locked in the latching hole of the main power transmission member, and a top of which is provided with a poking stick; a rocking slide, a groove at a bottom end of which provides for an emplacement of the poking stick of the eccentric wheel, a connection shaft at a top of which is connected with a rocking horse, and a side edge of which is provided with a sliding rod; when the motor drives and rotates the transmission gears, then mutually repelling of the upper and lower double-sided magnets drive and rotate the magnet impeller wheel, thereby causing whirling of the water and fluttering of the shiny disc snowflakes, moreover, the transmission shaft is caused to rotate, thereby rotating the main power transmission member to drive the eccentric wheel to rotate, the poking stick of the eccentric wheel to drive the rocking slide to rotate, the sliding rod of the rocking slide to move on the arc-shape lumps of the rocking support, so as to drive the rocking horse to sway back and forth.

* * * * *